United States Patent [19]

DuBois et al.

[11] Patent Number: 4,466,608

[45] **Date of Patent: * Aug. 21, 1984**

[54] MOVABLE TRAY SHEET SORTER

[75] Inventors: R. Clark DuBois, Fairfield; John C. Hamma, Milford, both of Conn.

[73] Assignee: Gradco Systems, Inc., Santa Ana, Calif.

[ * ] Notice: The portion of the term of this patent subsequent to May 11, 1999 has been disclaimed.

[21] Appl. No.: 344,473

[22] Filed: Feb. 1, 1982

Related U.S. Application Data

[63] Continuation of Ser. No. 146,145, May 2, 1980, abandoned.

[51] Int. Cl.[3] ..... B65H 39/11

[52] U.S. Cl. ..... 271/293; 271/221; 271/294

[58] Field of Search ..... 271/293, 294, 292, 295, 271/287, 288, 209, 221, 222, 279; 270/58

[56] References Cited

U.S. PATENT DOCUMENTS

| | | | |
|---|---|---|---|
| 958,798 | 5/1910 | Fischer et al. | 271/222 |
| 2,793,857 | 5/1957 | Rauschenberger | 271/221 X |
| 3,721,435 | 3/1973 | Zanders | 271/293 |
| 4,203,587 | 5/1980 | Kishi et al. | 271/293 |
| 4,220,325 | 9/1980 | Tates et al. | 271/293 |
| 4,253,656 | 3/1981 | Landa | 271/293 |
| 4,328,963 | 5/1982 | DuBois et al. | 271/293 |

*Primary Examiner*—Bruce H. Stoner, Jr.
*Assistant Examiner*—L. Rosenberg
*Attorney, Agent, or Firm*—Newton H. Lee, Jr.

[57] ABSTRACT

An apparatus is disclosed for receiving sheets from the discharge portion of an electrostatic copy machine, which apparatus receives, stacks and collates the sheets as desired. The apparatus can be electrically independent of the copier and is attached thereto by simple hanger and bracket arrangements. The apparatus includes a plurality of trays which are moved past the discharge opening of the copier, and which are controlled and arranged, selectively to receive (1) a plurality of sheets in each tray; (2) a single copy of each sheet in each of several trays; or (3) a number of identical sheets in one tray and a differing number of other sheets in successive trays. The apparatus can collect, collate, and sort the sheets while the trays are moving in one direction past the copier discharge opening, as well as when the trays are moving past it in the other direction. The apparatus will automatically conclude its sorting cycle whenever there is an extra-ordinary delay in the discharge of the sheets from the copier. In another embodiment, utilizing an appropriate connection to the copier, the apparatus can be arranged to complete its collating cycle only when the exact number of desired copies has been sorted (i.e. independently of any misfeed, delay, or jam-up in the copier operation).

12 Claims, 12 Drawing Figures

7
7
11
11
12
12
20
27
28
31
32
39a
39b
39c
40
41
42
42a
43
44
45
46
48
49
49a
49b
49c
49d
50
51
52
53
58a
59a
59b
66
67
1
2
3
4

MOVABLE TRAY SHEET SORTER

CROSS REFERENCE TO RELATED APPLICATION

This application is a continuation of our pending application Ser. No. 146,145 filed May 2, 1980, now abandoned.

BACKGROUND OF THE INVENTION

Copying machines equipped with sorting, collecting and collating devices are known, and we refer, for example to Stemmle U.S. Pat. No. 3,788,640, of Jan. 29, 1974, and Schulze U.S. Pat. No. 3,774,902, of Nov. 27, 1973. The devices disclosed in those and similar U.S. patents are principally utilized in connection with the operation of fairly large and complicated xerographic copy machines.

A compact sorter more closely related to the device of the present invention, is disclosed in our co-pending application, Ser. No. 98,546 filed Nov. 29, 1979, now U.S. Pat. No. 4,328,963, and in the pending application of Lawrence, Ser. No. 098,191 filed Nov. 27, 1979 now U.S. Pat. No. 4,343,463. The apparatus of the present invention is lightweight, compact, easily adapted for operation with a wide variety of makes and styles of xerographic copiers; and, more importantly, is inexpensive to manufacture.

The device of the present invention is portable and is simple to operate, requires no electrical connection to the copier, and is trouble-free and simple in its construction.

In an art which has grown rapidly in the last two decades, not only is it important to provide a means for producing multiple copies of a single sheet, but also multiple copies of a multiple-page document, and to do so in a manner which compliments the speed of production of the copier so that the collating, sorting, and assembling of the multi-page document does not consume more time than the copying did and so that the collated documents are ready as soon as the last of the pages of the document have been copied.

SUMMARY OF THE INVENTION

The compact collater and sorter of the present invention is a relatively small, box-like device adapted to be attached to the side of the copier adjacent to the copier's discharge opening in the place normally occupied by the receiving tray of the copier. A simple bracket and hanger arrangement enables the sorter to be sold independently of the copier and "hung" on the side of the copier without modifying the copier, and also enables the sorter to be sold as a part of the original equipment attached to the copier.

The apparatus is designed so that the power unit and motor for driving the sorter is independent of the electrical system of the copier, and so that the sheet-transport mechanism of the sorter not only is in contact with the discharge rollers of the copier in a manner which insures that the completed copy is carried into the sorting mechanism, but also so that the sorting mechanism transport apparatus runs only when the copier is operating.

A housing for the sorter supports a plurality of trays, and we have elected to illustrate ten such trays, although it is to be understood that any number of trays may be designed consistent with the style and size of the copier to which it will be attached.

The sheet-receiving trays are arranged in a closely spaced stack, either below or above the discharge opening of the copier, and the trays are spaced apart above the tray which is to receive the sheet being discharged from the copier as the trays are vertically shifted past the discharge opening. An auxiliary sheet transport is provided and driven by the copier transport, and the auxiliary transport is constructed in a unique manner to elevate sheets above a transverse tray shifting drive shaft, thereby simplifying the tray shifting drive mechanism.

A feature of the invention resides in the provision of a means for automatically moving the sheets, after they have been deposited in the trays, a further distance to prevent contact of the trailing end of the sheet with the transport rollers during return movement of the trays past the sheet entry location.

The sorting device of the present invention will be found to be relatively simple and easy to use and, therefore a principal object of the present invention is to provide an inexpensive, compact collater and sorter which can easily be attached to a copier without any electrical interaction with the operation of the copier.

Another object of the present invention is to provide a compact copier which can, selectively, collect a plurality of copies in a single tray, sort the copies so that one sheet will go into each tray, selectively, with a second sheet going into each of such trays, etc., or so that a group, i.e., a given number, of sheets go into one tray, and a different number of sheets go into the next tray, and a still different number into a third tray, etc.

Another object of the present invention is to provide a sorter which can collect the sheets as the receiving trays move either upwardly past the copier's discharge opening or downwardly past the discharge opening, wherein there is no possibility of a sheet's coming into contact with the discharge transport.

Another object of the present invention is to provide for a copy machine a collater and sorter which moves the trays or receptacles past the discharge opening of the copier under the control of a sensing device which determines when the sheet has been fully discharged from the copier.

With the above and other objects in view, a more complete understanding of the present invention can be achieved by referring to the following detailed description:

DETAILED DESCRIPTION

For the purpose of illustrating the invention, there is shown in the accompanying drawings a form thereof which is at present preferred, although it is to be understood that the various instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
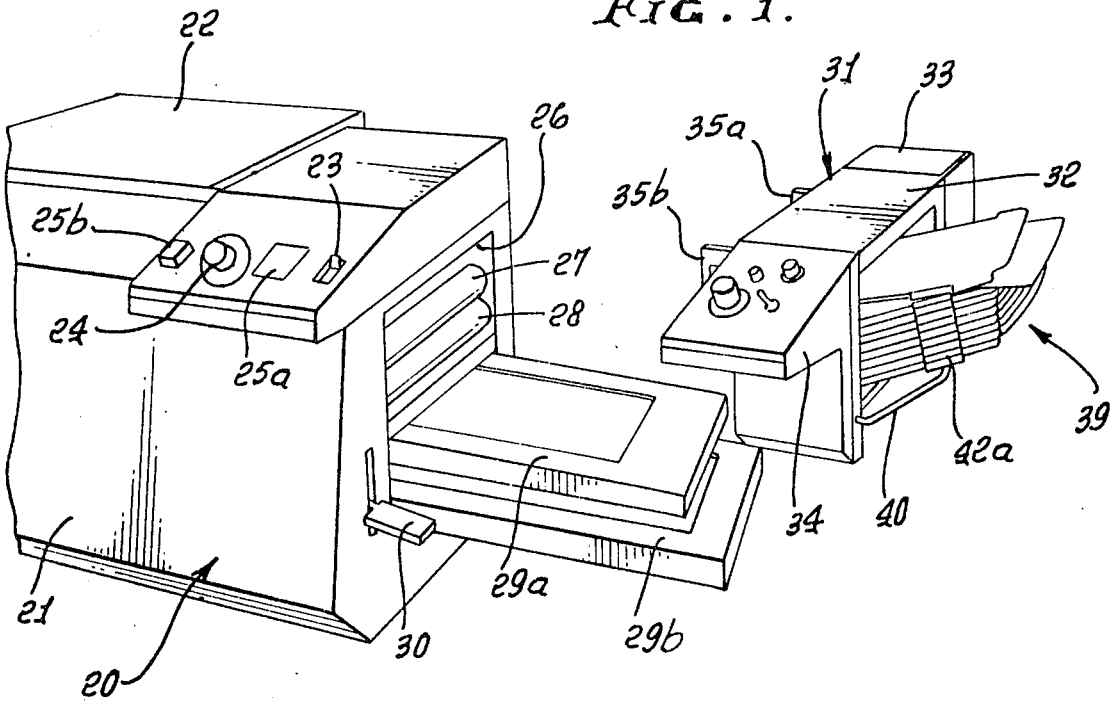
FIG. 1 is a perspective view of a copier machine showing the paper-discharge opening and with a sorter of the present invention about to be attached hereto.

Referring now to FIG. 1, we have illustrated an electrostatic copier 20 of a type well-known in the art. It includes a body 21 having a cover 22 beneath which the material to be copied is placed on a transparent plate during the copying action. It may include an on-off switch 23, a "number-of-copies" switch 24, a start button 25-*a*, and a "dark-light" control 25-*b*, all well-known in the art.

Also shown in FIG. 1 are paper-trays 29-*a* and 29-*b*, and a tray selector 30. The tray 29-*a* holds letter-size papers 8½"×11", and tray 29-*b* holds legal-size paper, 8½"×13 ".

As a copy is completed, it is discharged through the opening 26, carried by the exit rolls 27 and 28. In a non-stacking copier, a receiving tray (not shown) receives the paper after discharge from the rollers 27 and 28.

Figure 3:
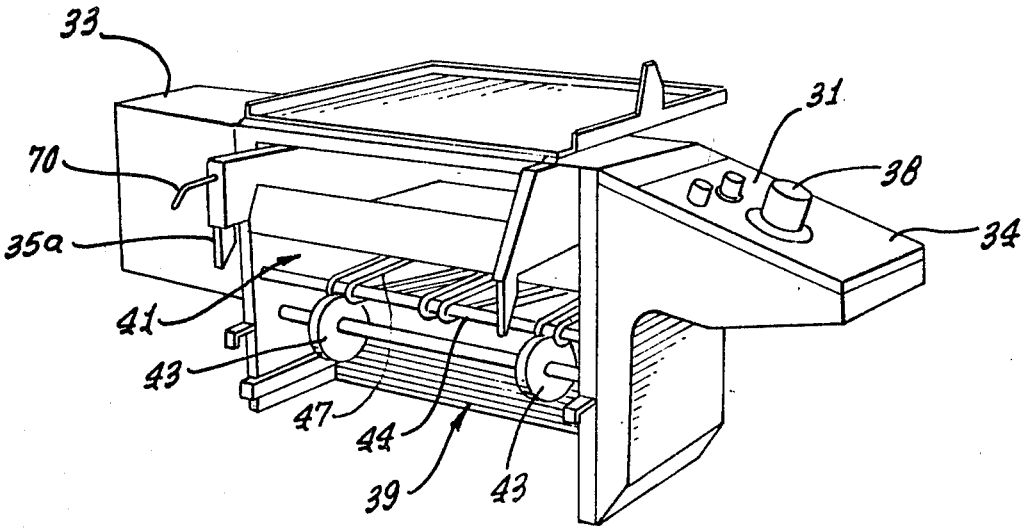
FIG. 3 is a perspective view of the sorter of the present invention looking at the back or receiving end thereof and with the trays disposed both above and below the sheet-receiving area.

Also shown in FIG. 1 is a collater-sorter of the present invention, indicated generally by the numeral 31. The sorter 31 generally includes a housing 32, having attached thereto a cover 33 for the motor and drive mechanism, and a control panel 34. The housing 32 has brackets 35-*a* and 35-*b* (shown more clearly in FIG. 3), which enable the sorter to be hung on the side of the copier adjacent the exit rollers 27 and 28. In this position, the control panel 34 of the sorter is adjacent to and aligned with the controls of the copier so that all of the control mechanisms are grouped together.

The control panel 34 of the sorter 31 includes an on-off switch 35-*c*, a pilot light 36 to indicate when the power of the sorter is turned on, a reset button 37, and a mode selector switch 38.

Figure 2:
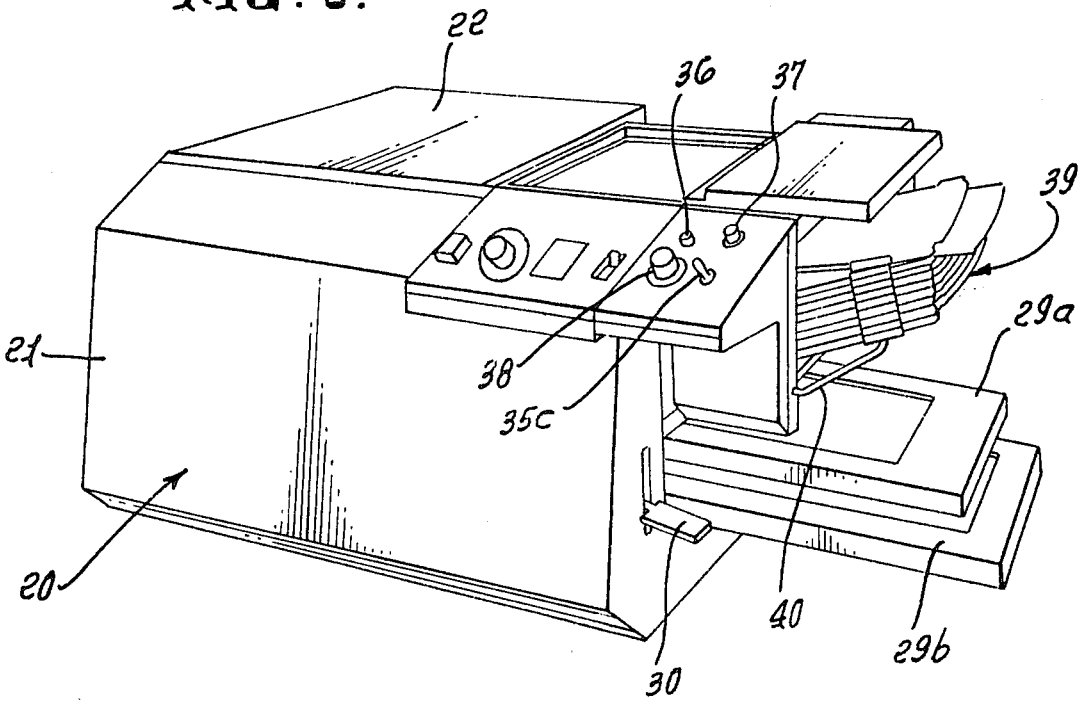
FIG. 2 is a perspective view of the sorter of the present invention attached to a copier machine.

As can be seen in FIGS. 1 and 2, the sorter also includes a plurality of paper-receiving trays 39, and a tray-support bracket 40.

All of this mechanism is compactly designed and assembled so that the sorter is supported neatly and conveniently on the side of the copier, above the paper supply trays 29 and 30, and in alignment with the exit rollers 27 and 28. It occupies no more space than the previous non-collating and non-sorting trays supplied with the copier.

Figures 6, 11, 12:
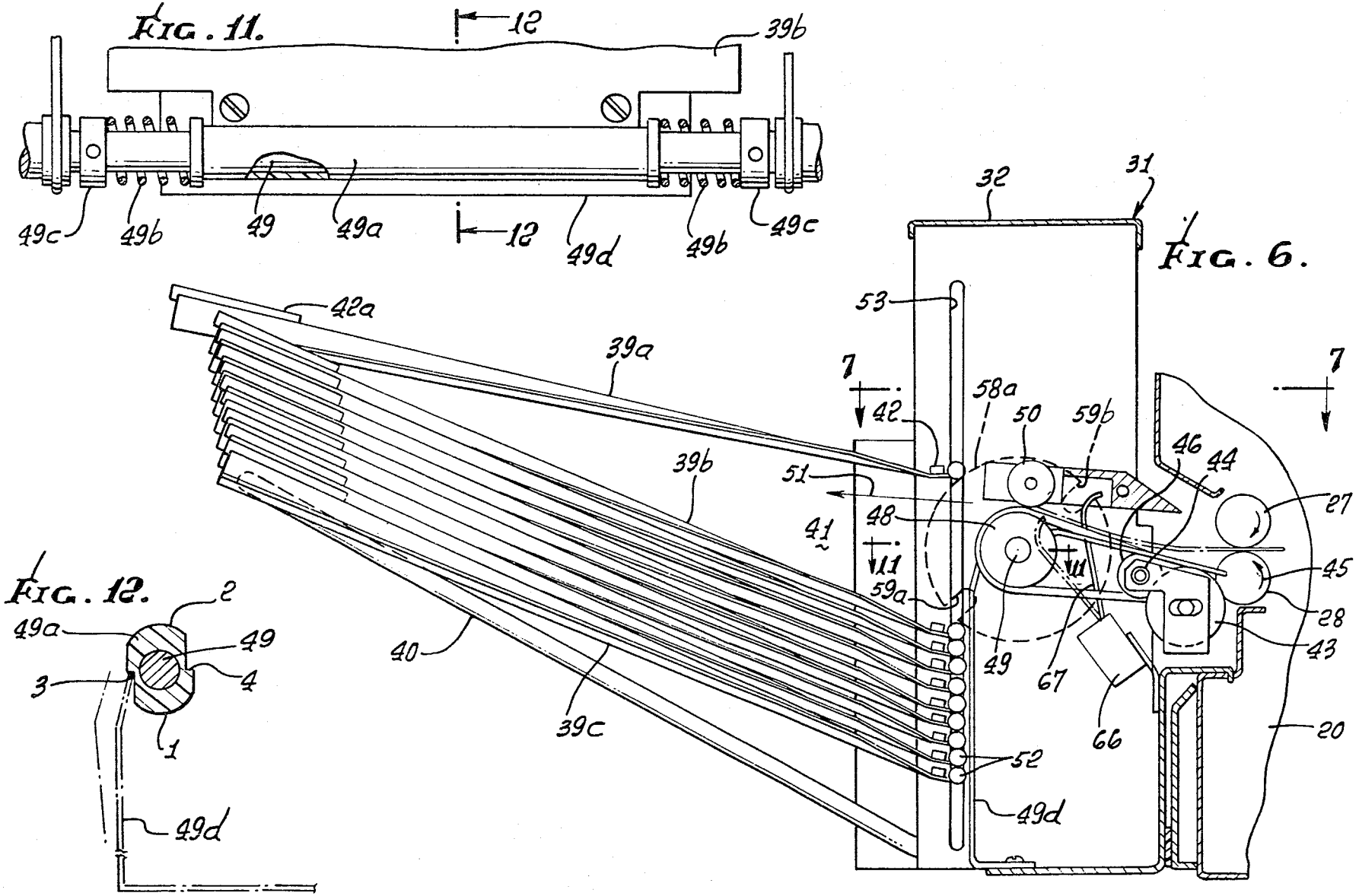
FIG. 6 is a vertical, cross-sectional view taken generally along line 6—6 of FIG. 4.
FIG. 11 is a fragmentary transverse section on the line 11—11 of FIG. 6.
FIG. 12 is a fragmentary vertical section on the line 12—12 of FIG. 11.

We refer now to FIG. 6 which, as a cross-sectional view, shows the relationship of the trays 39 and the housing 32 of the sorter as they are supported on the end wall of the copier 20. As mentioned above, the housing 32 is supported by brackets 35-*a* and 35-*b* on the end wall of the copier 20, holding the transport mechanism of the sorter in operative juxtaposition to the exit rolls 27 and 28 of the copier.

A friction drive wheel 43 is in contact with the lower exit roll 28 of the copier and also with the shaft 44 of the sorter so that when the copier is operating, the exit roll 28 rotates in a counter-clockwise direction (as shown by the arrow 45), and the frictional wheel 43 will rotate in a clockwise direction, and the shaft 44 will rotate in a counter-clockwise direction.

Attached to the shaft 44 are a plurality of pulleys or hubs 46 carrying the transport belts 47 which cause the lower exit roller 48 to turn on the drive shaft 49. The exit rollers 48 are free-wheeling on the drive shaft and rotate independently thereof.

Additionally, the upper exit roller 50 guides the paper between it and the drive belts 47 carrying the paper outwardly into the opening 41 of the trays 39 in the direction shown by the arrow 51.

The opening 41 is defined between an upper-tray 39-*a* and a lower-tray 39*b*.

The trays are inclined as shown in FIG. 6 and supported at their inner end on trunnions, rods or bars 52, which are affixed to the edges of the tray, and the ends of which are guided in the slots 53.

Foam rubber pads 42 are located on the upper surface at the inner end of each tray 39. These pads are adapted to clamp the paper on the respective trays tightly in place when the trays are moved together above or below the sheet-receiving opening 41. The outer end of each tray has a spacer guide 42-*a* to keep the tray ends separate and to enable them to pass over each other freely as the inner ends of the tray are moved up and down in the slot 53.

The bottom tray 39-*c* is supported at its outer end by the tray-support bar 40, at only one edge thereof (see FIG. 4), so that the operator can reach in to remove paper, either from the end of the trays or from the side of the trays.

Figure 4:
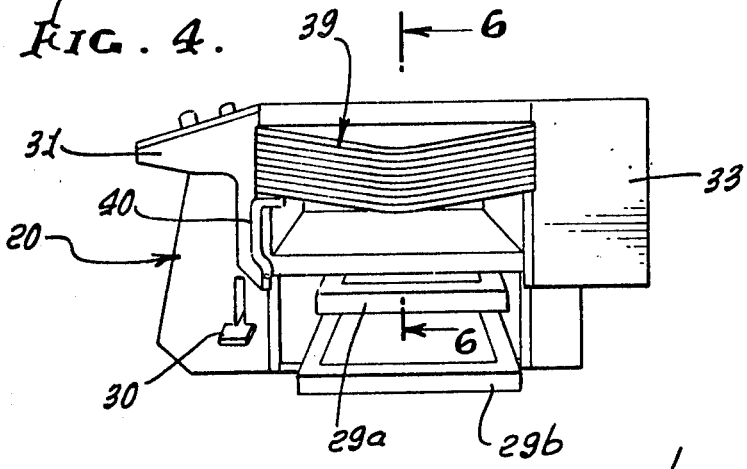
FIG. 4 is a front end view of a sorter of the present invention.
Figure 5:
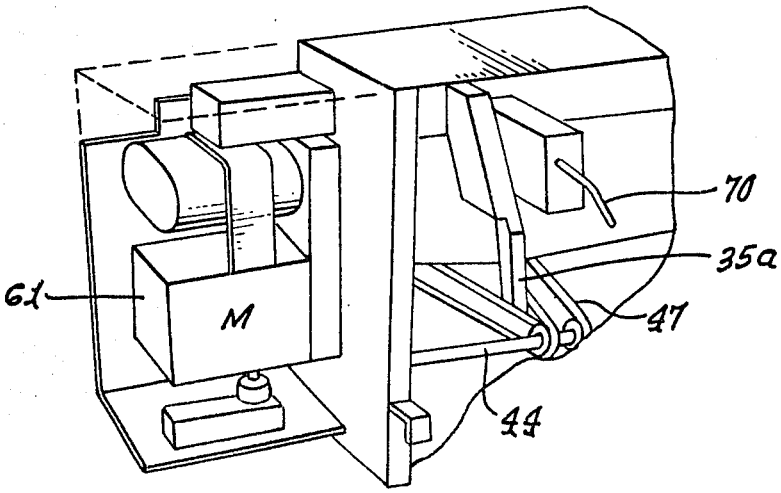
FIG. 5 is a perspective view of a motor and drive unit of the sorter of the present invention.

The trays 39 are "dished" at the outer end, as is seen particularly in FIG. 4, so that the curved sheet will be self-supporting, as it extends beyond the outer end of the tray and will not droop over the edge thereof.

Although the rods 52 for each of the trays 39 are free to slide up and down in the slot 53, the rods on the top tray 39-*a* and the bottom tray 39-*c* are longer than the rest and extend into engagement with a tray stop 55. The tray stop 55 prevents the uppermost tray 39-*a* from going to a position lower than that shown at 39-*b* in FIG. 6, and also prevents the lowermost tray 39-*c* from rising above that position 39-*b* shown in FIG. 6.

This insures that there will always be a tray beneath the arrow 51 to receive a sheet of paper as it exits from the transport belts 47.

Springs 57 connect the upper tray 39-*a* and the bottom tray 39-*c*, so as to bias the lower trays upwardly and insure that bars 52 of one tray will always be in contact with the transfer wheel 58. Gravity will always insure that the lowermost of all trays above the transfer wheel 58 will have its bars resting on the transfer wheel 58.

The two transfer wheels 58 are located one on each side of the inner frames 56 of the housing 32. The transfer wheels are affixed to the drive shaft 49, one transfer wheel 58-*a* being shown at the left side in FIG. 7, and the other transfer wheel 58-*b* shown at the right end of the shaft 49 in FIG. 7. Each of these transfer wheels 58-*a* and 58-*b* has a pair of slots 59*a* and 59*b* therein, disposed diametrically opposite as is seen particularly in FIG. 6. When the transfer wheels are rotated clockwise as seen in FIG. 6, the slot 59-*a* engages the pin or bar 52 on the tray 39-*b* which is biased upwardly beneath the wheel 58 by the spring 57. Rotation of approximately 90° of the wheel 58 elevates the tray to the position 39-*a* in FIG. 6, whereupon it will stay in that position, being supported by the outer circumference of the transfer wheel. Each transfer wheel turns 180° per transfer, thus bringing the slot 59-*b* 180° to the position previously occupied by the slot 59-*a* shown in FIG. 6.

It should be understood that the transfer wheels may have a single slot and turn 360° per transfer. Such transfer wheels are more particularly the subject of our above-identified application. However, in the present construction, the auxiliary transport rollers 48, elevate the sheet above the transfer wheels 58, so that a simple drive structure for the wheels 58, can be employed.

The transfer wheels 58 are turned by the drive shaft 49 under the impetus of the motor 61, through the universal joint or drive pin 62, which connects the hub 63 (affixed to the shaft 64 of the motor 61) and the hub 65 of the left-hand transfer wheel 58-*a*.

Thus, on proper signal, the transfer wheels are caused to rotate 180° each time a sheet of paper is discharged from between the exit roll 50 and the belts 47 of the sorter.

The sheets gravitate to the inclined trays as they leave the transport, so that the trailing edge of the sheets may possibly be contacted by the belts 47, as a tray is transferred upwardly. To prevent such contact, we provide the novel structure best seen in FIGS. 11 and 12.

Drive shaft 49, has a cam sleeve 49-*a*, made of elastomeric material rotatably disposed thereon, and clutch means drive the sleeve 49-*a* in one direction with the shaft but permits the sleeve to remain stationary when the shaft rotates in the other direction. In the form shown, the clutch means comprises coiled springs 49-*b* loading the sleeve 49-*a* between stop collars 49-*c* fixed on the shaft. A plate 49-*d* (also shown in FIG. 6) is mounted on the back of the housing and can flex at its lower end to be normally raised at its upper end towards the sleeve 49-*a*. Sleeve 49-*a* has two lobes 1 and 2, and radial shoulders, 3 and 4, corresponding with the number of transfer slots in the transfer wheels 58. Thus, when the shaft 49 rotates clockwise, as seen in FIG. 12 lifting a tray after deposit of a sheet, plate is flexed to the left and shifts a sheet lengthwise of the tray, so that the trailing edge of the sheet, which gravitates to the inclined tray, is displaced sufficiently that it cannot contact the transport belts 47 when the tray is moved downwardly. During left hand rotation of the shaft, the upper end of the plate 49*d* engages a rib 3 or 4 to hold the cam sleeve against rotation with the shaft, preventing interference of the plate with the downward moving tray.

The instructions for the transfer wheels to rotate is given by the paper-exit switch 66, which is mounted on the frame of the sorter and has its detector 67 disposed upwardly into the path of the sheet of paper as it is carried by the transport belts 47 from the exit rolls 27 and 28 of the copier toward the exit roll 50 of the sorter. The detector may be a micro switch or may be an optical beam of light or any appropriate means to sense the passage of the sheet along the transport belts.

The electric circuit is so arranged so that the switch 66 actuates and electric circuit and energizes the motor 61 after a sheet of paper has been discharged into the tray 39-*b* beneath the opening 41. Then the transfer wheels 58 rotate clockwise 180°, lifting the tray from the position 39-*b* to the position 39-*a*, and the sorter is ready to receive another copy into the opening 41.

The motor 61 is a reversible motor, and the electric circuit is arranged so that after all of the trays have moved upwardly from the lower "home" position, the next series or mode of sorting can take place on the downward movement of the trays. Thus when the motor is next energized, it rotates in the opposite direction, causing the transfer wheels to rotate in a counterclockwise direction when viewed in FIG. 6, thus causing the lower-most tray of the stack in the upper position to be carried to the position 39-*b* in FIG. 6, after the first sheet of the second page to be copied in the sorting arrangement has been discharged into the opening 41. Thereafter, continuous discharge of the next 9 copies will cause the trays 39 to "stack" downwardly, until all of the trays are located at or below the position 39-*b*.

Sequentially thereafter, the third page of the document will be added to the trays as the trays move upwardly, the fourth will be added as the trays move downwardly, etc.

As is well-known in the art, multi-page documents are copied in reverse order in a machine which discharges copies face up. This stacks the sheets in proper order and eliminates re-arranging the order when the copying is completed.

As has been previously here described and with reference to FIG. 2, a reset button 37 is included in the circuit so that all of the trays can be sent downwardly to the "home" position if so desired, rather than "stacking" downwardly as a new page is added to the assortment.

It will be noted from the previous description that the heart of the control and drive mechanism is the shaft 49. This shaft not only supports and causes the transfer wheels to rotate in synchronism, but also permits the transfer wheels to be located externally of the paper path. The rollers 48 which carry the transport belts 47, are also supported on the shaft 49, freely wheeling, so that all of the drive mechanism is located outside the path of the paper as it goes through the sorter.

Figure 10:
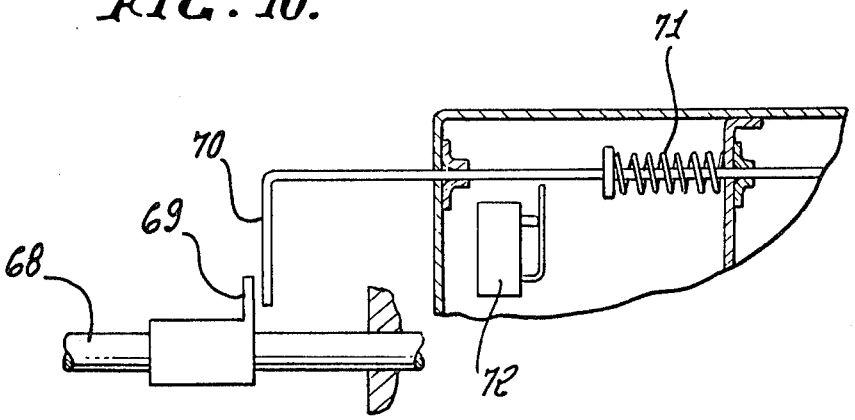
FIG. 10 is a fragmentary cross-sectional view, illustrating a trigger mechanism of one embodiment of the present invention wherein the timing impulse for the sorter is derived from the action of the moving optical carriage of the copier.

Although we have described the paper exit switch 66 as being the preferred method of detecting the passage of paper into the opening 41, and to direct the movement of the trays 39, we have illustrated in FIG. 10 an alternate control which is a trigger 70 actuated by the moving optical carriage 68 of the copier 20. A bracket 69 can be adjusted along the carriage 68, so that at the end of the movement of the optical carriage 18, the bracket 69 strikes the trigger 70, urging it against the spring 71 and into and out of appropriate contact with the switch 72. The switch 72 acts in a manner similar to the switch 66. A suitable time delay is interposed in the electrical circuit so that the rotation of the transfer wheels 58 will take place after the copied sheet of paper has passed out of engagement between the belts 47 and the exit roll 50 of the sorter.

In one embodiment of control mechanism and the sensing exit switch 67, the sorter can be completely electrically independent of the copier.

Figure 9:
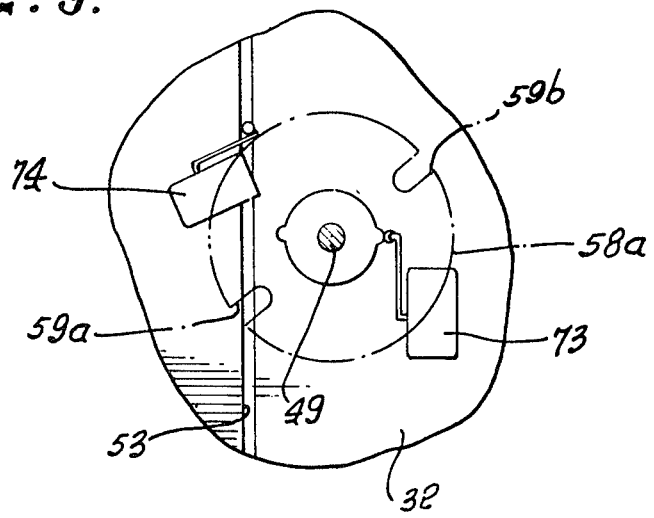
FIG. 9 is a side-elevational view of a transfer wheel showing the switches which control the tray advancing mechanism.

We have also shown in FIG. 9, a switch 73, which contacts the hub of the transfer wheel 58-*a* and insures that the transfer wheels rotate only 180° per passage of each sheet of paper through the sorter.

Additionally, we have indicated in FIG. 9 a "tray-home" switch 74 which can be set to insure the return of the trays into the lower or "home" position after all of the trays have been advanced upwardly to receive the paper to be sorted and when sorting is not to be done on the downward movement of the trays.

Figure 7:
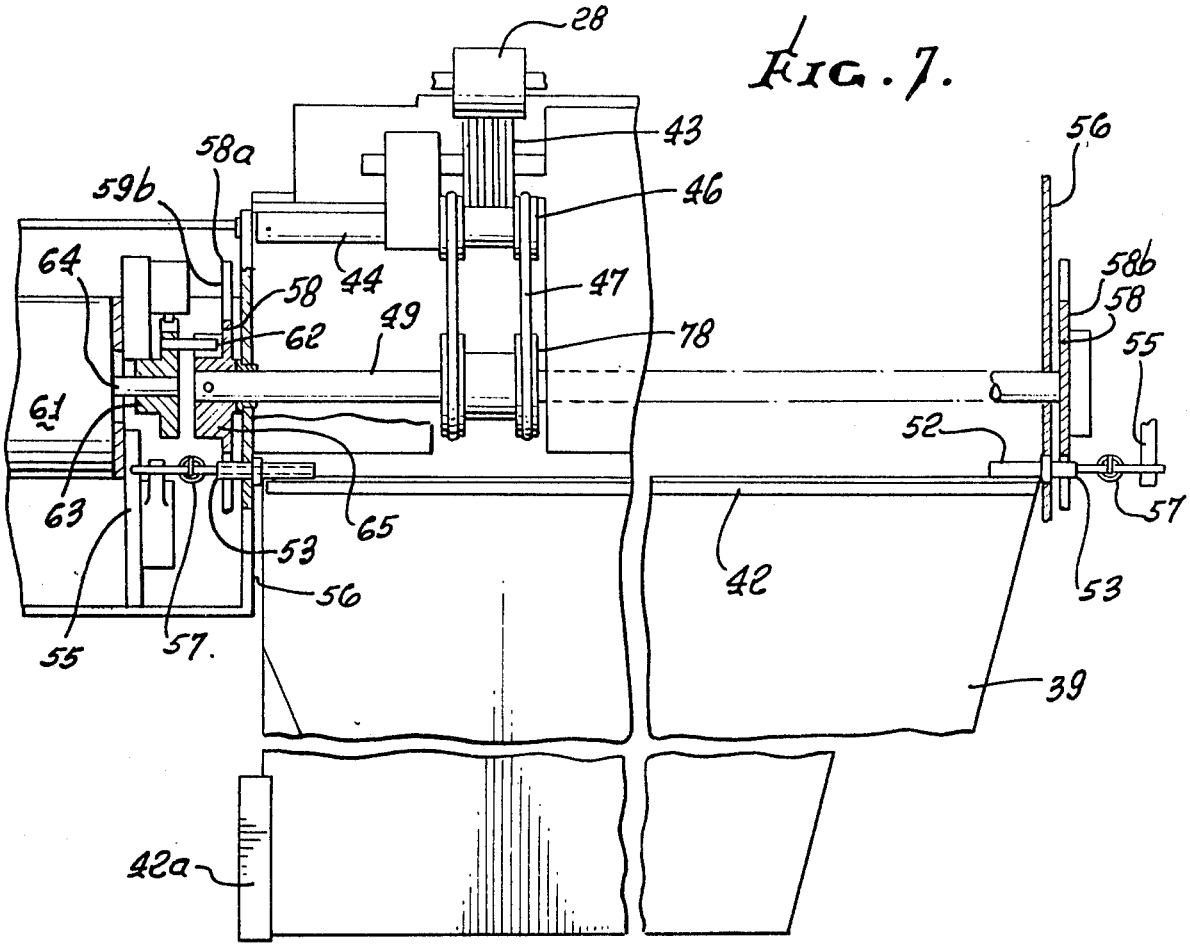
FIG. 7 is a fragmentary top-plan view of the drive mechanism of the sorter of the present invention, taken generally along line 7—7 of FIG. 6.
Figure 8:
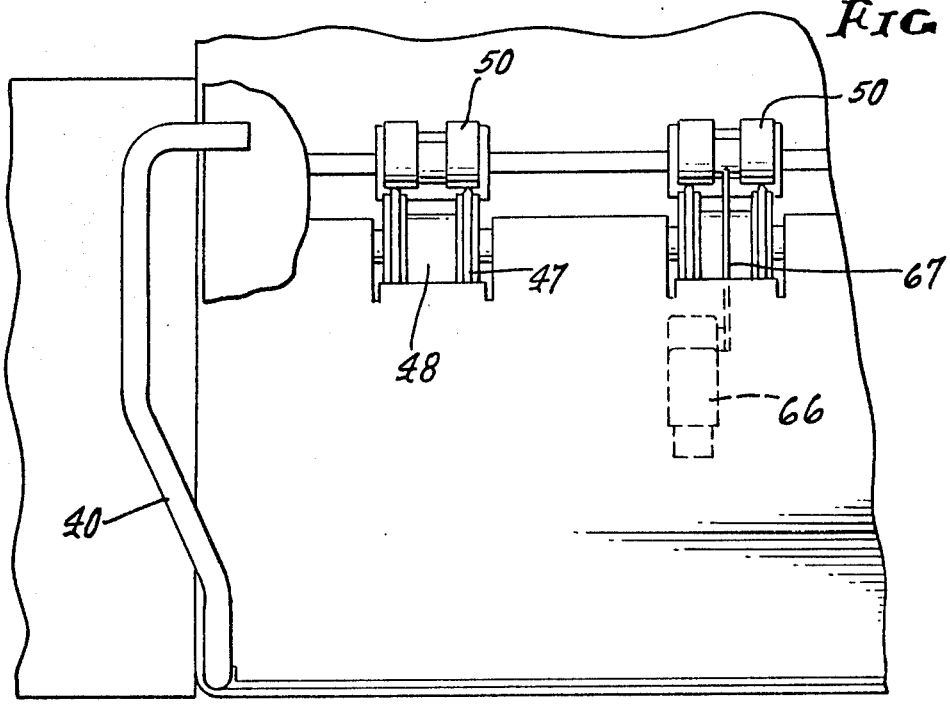
FIG. 8 is a fragmentary end elevational view of the sorter of the present invention showing the discharge rollers and transfer wheels, along with the sheet-sensing mechanism.

It will also be noted by reference to FIG. 7 that the hubs 46 on the shaft 44 all rotate in unison and thus drive the transport belts at a uniform speed.

We have shown the trays 39 as being inclined upwardly and outwardly in FIG. 6 as this configuration prevents the paper from "floating" out of the tray after discharge from the exit roll of the sorter. Moreover, the slight inclination causes the paper to settle back downwardly in the tray on top of the foam pieces 42, thus insuring that all of the sheets will be clamped between foam and the underside of the next uppermost tray when the trays are not in position 39-*b*. The foam rubber pads are about ¼" thick and when a full load of paper has been placed in each of the trays and the trays assembled either above or below the opening 41, the foam is compressed to about 1/32" of an inch so that no space is lost and yet the sheets are firmly gripped in place on the tray.

Time delay elements are incorporated in the controls so that the movement of the trays will not take place until after the paper exit switch is out of contact with a sheet of paper and the paper has been appropriately discharged into the opening 41 onto the underlying tray.

The "tray-home" switch previously referred to can be set to operate in conjunction with the reset switch so that the direction of the motor may be reversed, and the trays caused to move in the appropriate direction at the end of the upward or downward movement of the complete sets of trays.

As can be seen, this type of simple hang-on, plug-into-wall sorter, requires no mechanical or electrical skill to install and can be done by the customer, and there are no alterations or electrical connections needed to the copier.

As stated, the design of the trays is such that in at least some area, the paper is always exposed, permitting either end unloading or side unloading of the paper.

Although the paper extends beyond the end of the trays, the trays are curved, and this curved paper acts like a "beam" and is stiffened and will not droop beyond the edges of the trays. Thus, both short and long sheets can be handled with equal ease.

Furthermore, the trays are supported in such a manner at the outer end above the tray support bar 54, so that the stacked trays can be opened at their outer end for easy removal of the sheets, to clear the jams (if any exist) and to reach short sheets.

It is to be understood that the present invention may be embodied in other specific forms without departing from the spirit or special attributes hereof, and it is, therefore, desired that the present embodiment be considered in all respects as illustrative, and, therefore, not restrictive, reference being made to the appended Claims rather than to the foregoing description to indicate the scope of the invention.

We claim:

1. A sorting and collating apparatus for sheets comprising:

a frame, a plurality of trays disposed in a vertical stack, a tray support extending from said frame to support the outer end of the lowermost of said trays, a pair of sidewalls for said frame, vertically extended slots in said sidewalls, trunnions on the inner end of each tray and extending through said slots, a drive shaft supported by said side walls, a pair of transfer wheels mounted on said drive shaft, externally of said sidewalls, said transfer wheels each having at least one geneva-type slot adapted to engage said trunnions, means biasing the inner ends of said trays together, a space defined in said stack by engagement of said trunnions with said transfer wheels between the underside of the inner end of one tray and the upper side of the inner end of another tray, said transfer wheels constructed and arranged to move a tray upwardly and downwardly as the wheels are rotated in opposite directions and as the slots in the wheels engage the trunnions of the trays and as the trunnions are moved along the slots in the frame, a reversible electric motor connected to said drive shaft, an electric circuit including a sensing switch, said switch connected to the motor whereby to instruct the motor to rotate the transfer wheels after a sheet of paper has passed across the switch.

2. The apparatus of claim 1 wherein each transfer wheel has a pair of slots disposed 180° from each other.

3. The apparatus of claim 1 wherein a friction wheel is adapted to engage an exit roll of a copier, guide wheels and transport belts rotating freely about the drive shaft and providing a sheet transport from the copier having a discharge end to direct sheets to the trays, drive means between said friction wheel and said guide wheels to drive said guide wheels when said friction wheel is driven.

4. The apparatus of claim 1 including a reversing switch adapted to engage a tray to cause the motor to turn in one direction to move the trays in an upward direction and also to cause the motor to move the trays downwardly.

5. The apparatus of claim 3 including a stop to insure that one tray is always located in paper-receiving position adjacent and beneath the discharge end of the transport belts.

6. The apparatus of claim 1 wherein the drive shaft is centrally located beneath the path of the paper through the apparatus.

7. The apparatus of claim 1 including a cam and finger constructed and arranged to align the sheets of paper in each tray and to space said sheets from the frame of the apparatus.

8. A sorting and collating apparatus for sheets comprising:

a frame adapted to be mounted at the sheet outlet of a sheet feeder, a plurality of trays disposed in a vertical stack, means supporting the outer ends of said trays for pivotal movement, tray shifting means engageable with the inner ends of said trays to vertically shift said inner ends past said sheet outlet and space said inner ends to receive a sheet on a tray below said outlet, and sheet shifting means operable by said tray shifting means to engage the sheet on the tray below said outlet and move said sheet towards said outer end, including a drive shaft, a cam member on said shaft, slip clutch means to cause rotation of said cam member with said shaft in one direction, and a member fixed on said frame and engaged with said cam member to be moved thereby in a direction to engage and move the sheet upon rotation of said cam in said one direction and to hold said cam against rotation in the other direction.

9. A sorting and collating apparatus for sheets comprising:

a plurality of trays disposed in a vertical stack, a frame adapted to be mounted at the sheet outlet from a copy machine, sheet transport means in said frame including a horizontal shaft and a sheet feeding member mounted upon and revolvable about said shaft, means for rotating said sheet feeding member about said shaft, Geneva wheels rotatable with said shaft at opposite sides of said trays, and trunnions at opposite sides of said trays engageable by said Geneva wheels to raise and lower the trays upon revolution of said shaft from below said transport means to above said transport means responsive to revolution of said shaft, and drive means to intermittently rotate said shaft.

10. The apparatus of claim 9: including sheet shifting means operable upon rotation of said shaft to raise a tray to engage a sheet on the tray and displace said sheet longitudinally on the tray away from said transport means.

11. The apparatus of claim 9: said shaft being rotatable in opposite directions while said sheet feeding member rotates continuously in one direction only.

12. A sorting and collating apparatus for sheets comprising:

a plurality of trays disposed in a vertical stack, a frame adapted to be mounted at the sheet outlet from a copy machine, sheet transport means in said frame including a horizontal shaft and a sheet feeding member mounted upon and revolvable about said shaft, means for rotating said sheet feeding member about said shaft, tray shifting means operable by said shaft, and means on said trays engageable by said tray shifting means to raise and lower the trays upon revolution of said shaft from below said transport means to above said transport means responsive to revolution of said shaft, and drive means to intermittently rotate said shaft.

* * * * *